US005207344A

United States Patent [19]

Davies et al.

[11] Patent Number: 5,207,344

[45] Date of Patent: May 4, 1993

[54] TRASH AND CONTAINER WASTE RECEPTACLE

[76] Inventors: John C. Davies, 1166 East 12 Avenue, Vancouver, B.C. V5T 2J9, Canada; Henry J. Davies, RR 1, Bowen Island, B.C., V0N 1G0, Canada

[21] Appl. No.: 760,325

[22] Filed: Sep. 16, 1991

Related U.S. Application Data

[63] Continuation-in-part of Ser. No. 585,514, Sep. 20, 1990, abandoned.

[51] Int. Cl.[5] ..... B65D 21/02

[52] U.S. Cl. ..... 220/23.83; 220/909; 220/408; 220/480; 232/43.4

[58] Field of Search ..... 220/909, 908, 23.83, 220/23.86, 481, 480, 671, 673, 676, 400, 408, DIG. 13, 669, 661; 232/43.1, 43.2, 43.4; 248/552

[56] References Cited

U.S. PATENT DOCUMENTS

| | | | |
|---|---|---|---|
| 644,119 | 2/1900 | Witt | 220/671 |
| 686,954 | 11/1901 | Riley | 232/43.2 |
| 930,842 | 8/1909 | Conley | 220/909 |
| 1,013,775 | 1/1912 | Hoffman | 220/909 |
| 1,441,040 | 1/1923 | Stephenson | 220/480 |
| 1,879,858 | 9/1932 | Schroedter | 232/43.5 |
| 2,063,507 | 12/1936 | Karper | 232/43.2 |
| 2,754,991 | 7/1956 | Hagerty et al. | 220/481 |
| 2,928,568 | 3/1960 | Franklin | 220/408 |
| 3,075,692 | 1/1963 | Lumley | 232/43.1 |
| 3,212,660 | 10/1965 | Adell | 220/481 |
| 3,224,670 | 12/1965 | Wetlesen | 232/43.1 |
| 3,428,245 | 2/1969 | Burdett | 232/43.2 |
| 4,893,722 | 1/1990 | Jones | 220/23.83 |
| 4,948,004 | 8/1990 | Chich | 220/909 |
| 4,964,523 | 10/1990 | Bieltvedt et al. | 220/909 |
| 5,011,036 | 4/1991 | Souza et al. | 220/908 |
| 5,044,483 | 9/1991 | Stefan | 232/43.2 |
| 5,052,198 | 10/1991 | Watts | 248/552 |
| 5,062,540 | 11/1991 | Jenkins | 220/23.83 |

FOREIGN PATENT DOCUMENTS

| | | | |
|---|---|---|---|
| 1533841 | 11/1978 | United Kingdom | 220/909 |

*Primary Examiner*—Allan N. Shoap
*Assistant Examiner*—S. Castellano
*Attorney, Agent, or Firm*—Shlesinger Arkwright & Garvey

[57] ABSTRACT

The present invention is directed to an apparatus for the segregated collection of different types of waste materials such as bottles or cans and comprises a segregated trash receiving unit which is placed within a conventional trash can such as a standard 55-gallon drum. The trash receiving unit is affixed to the interior wall of the exterior trash can and is additionally provided with an opening aligned with an opening extending through the side wall of the exterior trash can. The opening in the trash receiving unit is larger than the opening in the exterior trash can so that when cans and bottles which are placed through the exterior trash can opening and into the trash receiving unit, the collected bottles and cans may be easily dumped out of the trash receiving unit once it is removed from the exterior trash can.

13 Claims, 4 Drawing Sheets

TRASH AND CONTAINER WASTE RECEPTACLE

This application is a continuation-in-part of application Ser. No. 07/585,514, filed Sep. 20, 1990, now abandoned and entitled "Trash and Container Waste Receptacle".

FIELD OF THE INVENTION

The present invention relates to refuse collection apparatus and in particular to apparatus adapted for the segregation of different types of refuse, specifically recyclable trash materials.

BACKGROUND OF THE INVENTION

In recent years, efforts have been directed toward the reclamation and reuse of certain recyclable refuse such as aluminum cans, glass bottles, plastic containers and newspapers to name a few.

A common problem associated with recycling trash is the effort extended to separate the recyclable trash from the non-recyclable trash once it has been collected. Although the public supports the ecological and economic benefits of recycling trash, the majority of the public will remain unwilling to participate in such programs until the segregation of recyclable items can be made less burdensome and more convenient.

A number of attempts have been made in the past to provide compartmented trash receptacles which allow in situ segregation of waste. U.S. Pat. No. 4,878,592 (Lee) discloses a trash receptacle including an outer container body receiving a plurality of inner complementary receptacle units, each of which has an open top. U.S. Pat. No. 4,750,638 (Sosower) discloses a trash organizer comprising a trash can divided into two compartments for the use of two side by side trash can liners which are clipped to the perimeter of the can. U.S. Pat. No. 4,905,853 (Strawder) discloses a trash can incorporating three trash bag liners and a trash can cover with separate openings for each of the compartments. Another waste receptacle is disclosed in U.S. Pat. No. 1,013,775 (Hoffman) which describes a receptacle provided with an upper and a lower portion, the lower end of which has an opening to provide for entrance for waste paper.

OBJECTS AND SUMMARY OF THE INVENTION

The present invention relates to apparatus for the segregated collection of different types of recyclable waste materials by provision of a one-piece segregated trash receptacle unit fitted within a conventional trash can such as the standard 55 gallon drum. The side of the conventional trash can is provided with a recyclable waste opening which is centrally aligned with the opening in the trash receptacle unit so that cans, bottles or other recyclable trash placed therein are conveniently segregated at the time they are deposited within the trash can.

Another object of the present invention is to provide a trash receptacle which can be used in combination with a conventional trash can or separately, when hung on a wall or other supporting surface.

Still another object of the present invention is to provide a segregated waste receptacle unit which is easily attached to a conventional trash can and readily removed from the same.

A further object of the present invention is to provide a waste receptacle which can be manufactured from a variety of materials including plastics, fiber glass, or metal.

An additional object of the present invention is to provide a segregated waste receptacle unit which, when used in combination with a conventional trash can, does not interfere with the normal use of the conventional trash can.

Another object of the present invention is to provide a waste receptacle having a sloping top thereby allowing placement of a conventional trash can liner within the conventional waste receptacle and minimizing interference therewith.

Still a further object of the present invention is to provide a novel locking means for attaching the trash receptacle unit to the interior of a conventional trash can thereby preventing theft or undesirable removal of the unit from the conventional trash can.

Yet another object of the present invention is to provide a combination receptacle and support bracket for mounting the unit upon a wall or other supporting surface.

An additional object of the present invention is to provide a trash receptacle unit which is also adaptable for use as a repository for a wide variety of objects other than recyclable trash and, in particular, those associated with mail carrier services such as letters, packages or the like.

Another object of the present invention is to provide a combination receptacle unit and support bracket which allows the unit to be easily detached from its bracket when emptying the contents collected therein.

A still further object of the present invention is to provide a combination receptacle and support bracket which is provided with a novel locking means to prevent theft of the receptacle and the contents collected therein.

Yet another object of the present invention is to provide a trash receptacle which encourages recycling, reduces litter and is aesthetically pleasing.

Another object of the present invention is to provide a receptacle for segregating cans and bottles from general wastes and which interfits with conventional 55-gallon waste containers.

The present invention relates to a trash receptacle comprising a segregated trash receiving unit; the trash receiving unit includes a front wall, rear wall, first end and second end. The rear wall has a height substantially less than the height of the front wall. The rear wall is further provided with a generally planar surface and includes at least two spaced, substantially parallel, non-interconnected, vertical, reinforcing ribs which extend from the first end to the second end. Only one of the first end or second end has a sloping surface which extends from the front wall to the rear wall. The front wall further includes a waste opening aligned between the rear wall reinforcing ribs. The receptacle has a height; and a width which is substantially less than the height.

The present invention also relates to a wall mountable bracket assembly adapted to support a receptacle from its rear and bottom surfaces comprising a substantially rigid support frame and including an elongated vertical member having first and second ends. The bracket assembly is provided with a cross member, supported by the first end of the elongated vertical member and extending substantially perpendicular thereto. The cross member additionally includes means for supporting the receptacle rear wall. A foot portion is connected to the elongated vertical member second end and extends substantially perpendicular to the elongated vertical member and the cross member. The foot portion further includes means for engaging the receptacle bottom wall and means for mounting the entire bracket assembly to a wall or other supporting surface.

The present invention is additionally directed to a receptacle and bracket assembly for mounting to a wall or other supporting surface and comprises a receptacle having a rear surface and a bottom surface and a substantially rigid support frame including an elongated vertical member having first and second ends. A cross member supported by the first end of the elongated vertical member extends substantially perpendicular to the elongated vertical member. The cross member includes means for supporting the receptacle rear surface. A foot portion is connected to the elongated vertical member second end and extends substantially perpendicular to the elongated vertical member and the cross member. The foot portion further includes means for engaging the receptacle bottom surface. Means are also provided for mounting the bracket assembly to the wall or other supporting surface.

BRIEF DESCRIPTION OF THE DRAWINGS

FIGS. 1 through 4

Figure 1:
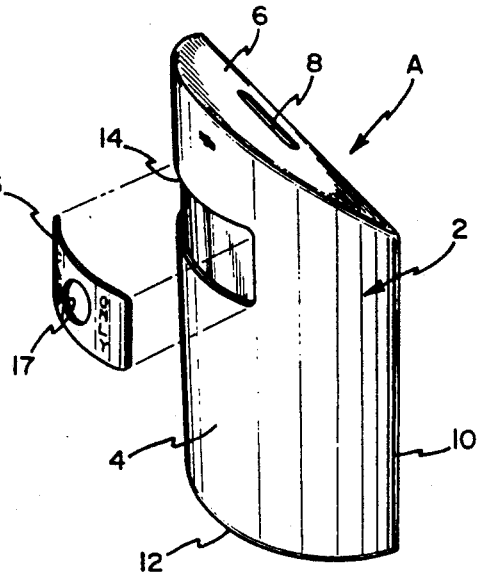
FIG. 1 is a perspective view of the trash receptacle unit according to the present invention and showing an opening in the front wall.

Referring now to the accompanying drawings and initially to FIG. 1, an apparatus for segregating collection of different types of wastes or other materials is shown generally by reference letter A and includes a segregated trash receiving unit or insert 2 having a convex front wall 4, a generally sloping first end 6, a generally planar rear wall 10 and a second end 12 defining an interior C. It is within the scope of the invention to provide a sloping surface on the second end 12 while providing a generally flat surface for the first end 6. Additionally, a handle 8 may optionally extend through the surface of the first end 6.

Figure 4:
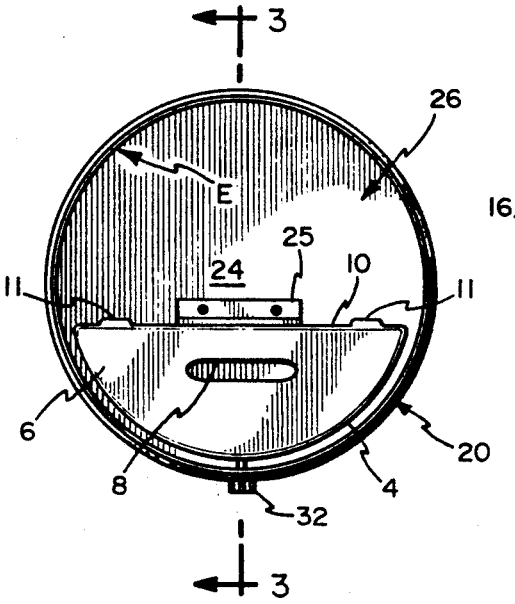
FIG. 4 is a top plan view of the receptacle unit and conventional trash can apparatus shown in FIGS. 2 and 3.
Figure 9:
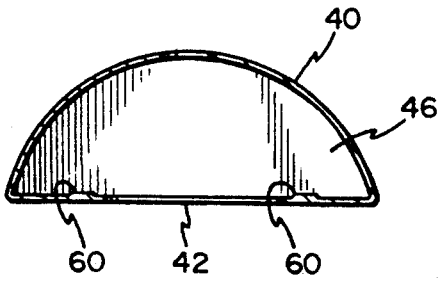
FIG. 9 is a top plan view of the device shown in FIG. 6 but with the support ribs extending towards the interior of the receptacle unit.

The rear wall 10 of the trash receiving unit or insert 2 is provided with two spaced, substantially parallel, vertical reinforcing ribs 11 as best shown in FIG. 4. The ribs 11 extend from the first end 6 to the second end 12. The ribs may project outwardly from the surface of the back wall 10 or, in the alternative, may be recessed inwardly toward the interior C of the receptacle unit 2 and as best shown in FIG. 9.

The unit 2 further includes a first opening 14 which extends through the front wall 4 and into the interior C of the unit 2. The particular size of the first opening 14 is dependent upon the selected utility of the unit or insert 2. For example, if aluminum cans are to be collected, the first opening 14 would have a size slightly larger than the diameter of a standard twelve ounce beverage can.

Figure 2:
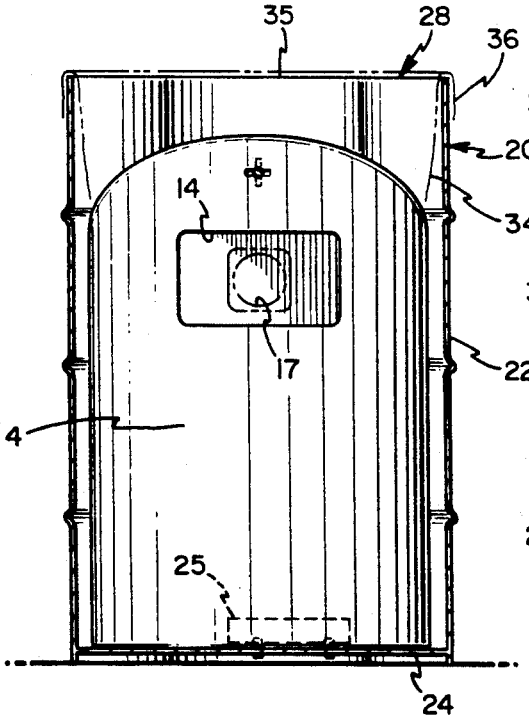
FIG. 2 is a vertical, cross sectional view and shows a label plate in phantom lines attached to a conventional drum or trash container with the receptacle unit shown in FIG. 1 inserted therein.

A label plate 16 is obtained by cutting out the first opening from the front wall 4 of the unit 2. The label plate 16 may include advertisement, instruction indicia or the like. The label plate 16 further includes a struck-out opening 17 which may be circular as shown in FIGS. 1 and 2 or of other geometry. The label plate 16 is centered about the exterior of opening 30 when the unit 2 is used in conjunction with a conventional 55-gallon drum or other exterior container body 20. The opening 30 of container body 20 may be a rectangular shape as shown in FIGS. 2 and 3, but other configurations are envisioned as being within the scope of the present invention.

The positioning of the label plate 16 over the opening 30 reduces the possibility of injury to the users hand when an article is placed through the opening 30 and into first opening of the unit 2. It is within the scope of the present invention that label plate 16 may be formed from a wide variety of materials as well as obtained from sources other than the struck-out portion 16. For instance, the plate 16 could be made by stamping metal.

Figure 3:
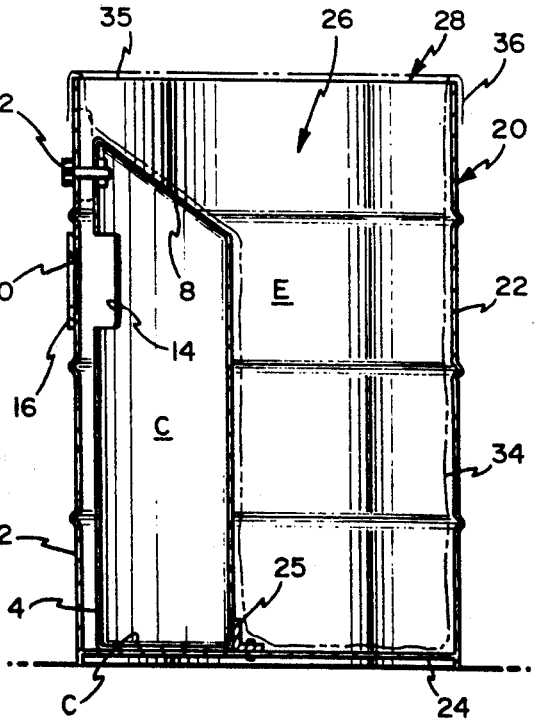
FIG. 3 is a vertical, cross sectional view taken along line 3—3 of FIG. 4 and viewed in the direction of the arrows and showing a liner bag in phantom lines.

Turning now to FIGS. 2 and 3, the unit 2 is shown positioned within the exterior container body 20. The exterior container body 20 has generally circular side surfaces 22, as well as a bottom surface 24 defining an interior area E. The exterior container body 20 further includes a top opening 28 which leads to the interior receiving area 26. The opening 30 extends through the side surface 22 of the exterior container body 20. As noted above, the exterior container body 20 can be a standard 55-gallon oil drum which is currently known to have wide acceptance in the trash collection industry as a refuse container. When incorporated into the present invention as exterior container 20, the 55-gallon oil drum is required to have the opening 30 cut into the side surface prior to use. The present invention is not limited to such drum-like containers and it is within the present scope to select any of the wide variety of containers which are currently available in the market or which may be manufactured in accordance with the general requirements set forth herein.

As best shown in FIG. 2, when the receptacle unit 2 is positioned within the exterior container body 20, the opening 30 of the exterior container body 20 is aligned with the first opening 14 of the receptacle unit 2. In addition, use of the unit 2 in conjunction with the exterior container body 20 will require that the first opening 14 of the unit 2 be of a substantially greater size than the opening 30 of exterior container body 20. The practical result of this arrangement is that the opening 30 will only accommodate bottles, cans or other trash of a particular size and shape. Thus, when a user approaches the exterior container 20 to deposit his trash, he will specifically place any recyclable bottles and cans through the opening 30 within the exterior container 20 while placing the remaining, non-segregated trash into the top opening 28 of the exterior container 20. With continued use, the interior C of unit 2 becomes filled with a sufficient amount of segregated bottles and cans. The unit 2 is then removed from the exterior container body 20 and the collected bottles and cans therein are emptied from the large opening 14 within the unit 2. In this way, the recyclable bottles, cans or other material are conveniently segregated and dumped from the remainder of the waste.

The unit 2 is affixed to the interior E of the exterior container body 20 by any number of means available and known within the art. As best shown in FIGS. 2, 3 and 4, an L-shaped bracket 25 may be positioned and secured to the bottom surface 24 of the exterior container body 20. The unit 2 is then secured to the interior E of the exterior container body 20 by use of L-shaped bracket 25. Additional securing means, such as a key lock 32 or other standard mechanical fastener can be used to secure the receptacle unit 2 to the exterior container body 20. For example, FIGS. 16 and 17 disclose a latch 62 whereby a plate portion 64 is pivotally connected at end 66 to the interior E of the exterior container body side surface 22. The plate portion 64 is further provided with an opening 68 through which an extended portion or L-shaped bracket 70 of unit 2 projects. A slot or opening 72 within extended portion or bracket 70 can then be used to accommodate a padlock (not shown) or similar device to secure the unit 2 within the exterior container body 20.

Returning now to in FIG. 3, a trash can liner 34 is positioned within the receiving area 26 of the exterior container body 20 after the receptacle unit 2 has been secured within the exterior container body 20. The liner 34 extends over the sloping first end 6 of the unit 2 and additionally into the receiving area 26 not occupied by the receptacle unit 2. The end portion 36 of the liner 34 extends beyond the top opening 28 of the exterior container body 20 and is secured to or otherwise attached about the rim 35 of exterior container body 20. In a preferred embodiment of the present invention, the uppermost portion of the sloping first end 6 of receptacle unit 2 is positioned a substantial distance below the rim 35 of the exterior container body 20. In this way, the unit 2 has minimal interference with user access to the general trash receiving area 26 of exterior container body 20. Non-segregated trash which is deposited within the general receiving area 26 of the exterior container body 20 will then accumulate unimpeded.

Figure 16:
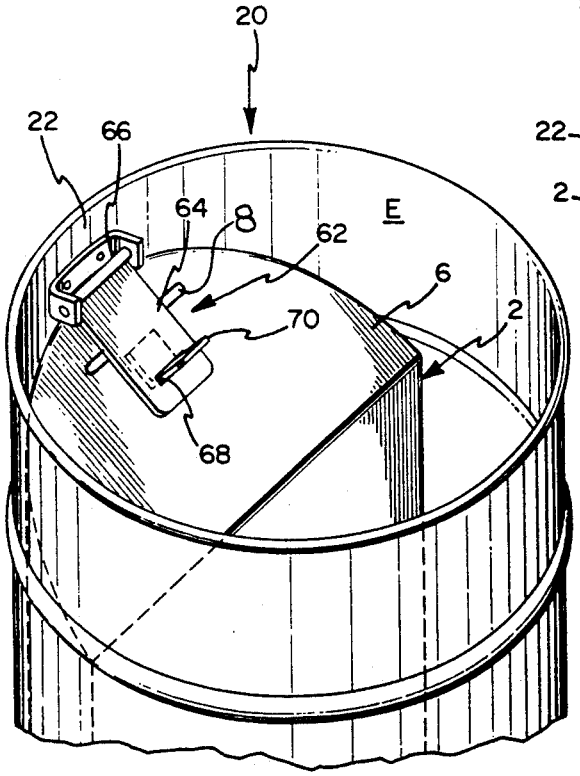
FIG. 16 is an enlarged, fragmentary, perspective view of the locking device when the receptacle is positioned within a conventional drum or trash container.
Figure 17:
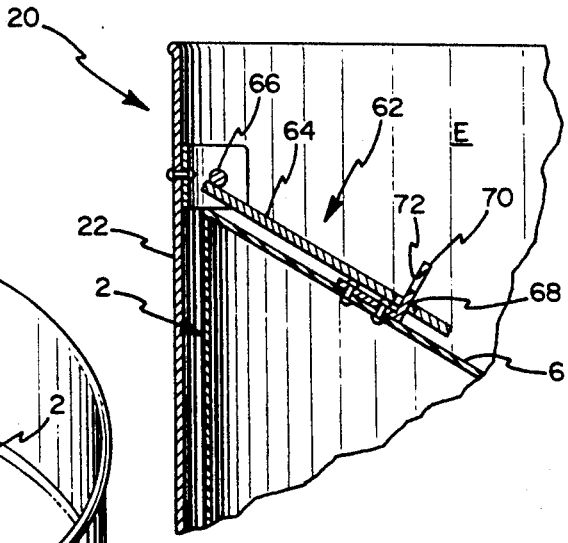
FIG. 17 is an enlarged, fragmentary, side view of the securing means shown in FIG. 16.

In use, the unit 2 will convert a conventional exterior container or 55-gallon drum 20 to allow it to function for collection of not only general waste, but segregated waste as well. Once the unit 2 has been sufficiently filled with bottles, cans or similar recyclable waste, it may then be removed from the interior E of the exterior container 20 through disassembly of the securing means 32 (or latch 62 as shown in FIGS. 16 and 17) followed by lifting of the unit 2 by the handle 8 out of the exterior container 20. Once removed, the receptacle unit 2 can be emptied of collected cans or bottles therein through the relatively large opening 14. After emptying, the unit 2 is reinserted within the exterior container 20 for continued segregated trash collection.

FIGS. 5 through 9

Figure 5:
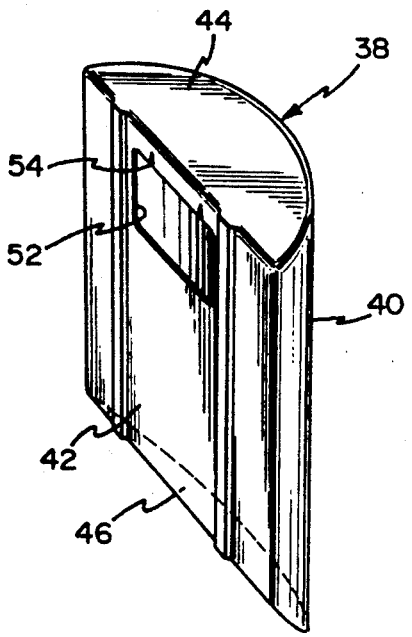
FIG. 5 is a perspective view generally showing the segregated trash receiving unit of FIG. 1 when alternatively used in an inverted manner and modified to further include a second opening in the rear wall provided with notches and where the struck-out portion is positioned near the horizontal end.
Figure 6:
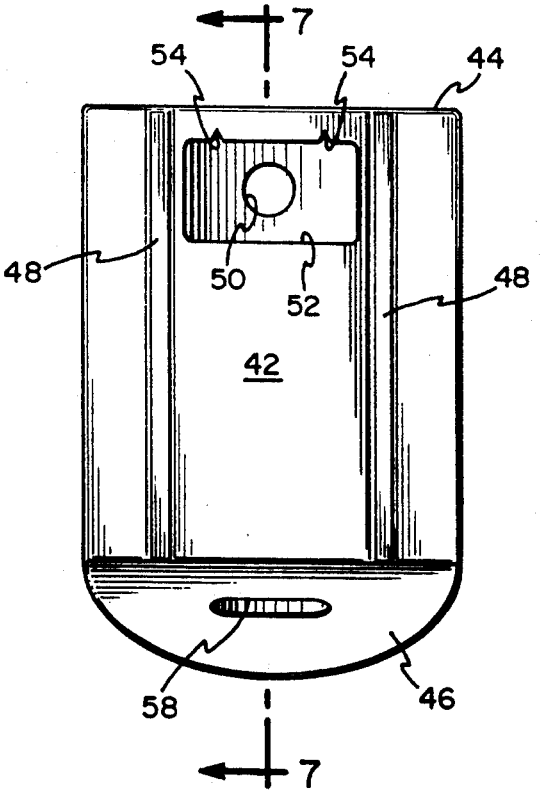
FIG. 6 discloses a back plan view of the segregated trash receiving unit shown in FIG. 5.

A segregated trash receptacle unit 38 is shown in FIGS. 5 and 6 as having a convex front wall 40, a rear wall 42 of generally planar construction, a first end 44 and a second end 46. The rear wall 42 has a height substantially less than the height of the front wall 40. The first end 44 is generally flat while the second end 46 has a downward slope extending from the rear wall 42 to the front wall 40. The sloping surface may optionally include a handle 58 extending therethrough.

Figure 8:
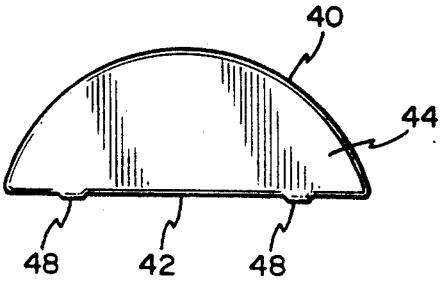
FIG. 8 is a top plan view of the device shown in FIG. 6.
Figure 7:
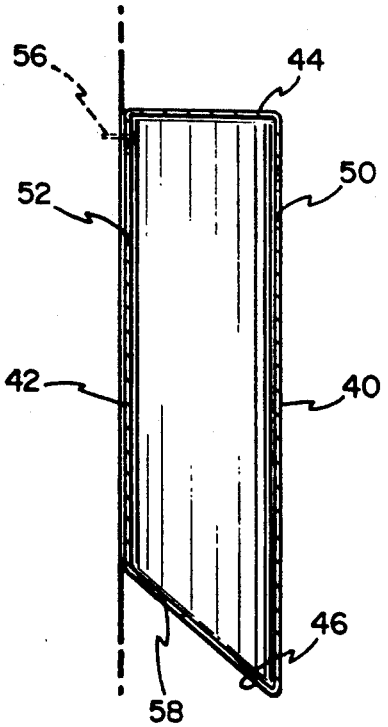
FIG. 7 is a side, cross sectional view of the segregated trash receiving unit taken along line 7—7 in FIG. 6 and viewed in the direction of the arrows and further showing the inverted receptacle unit mounted upon a wall.

The rear wall 42 further includes two substantially parallel, vertical support ribs 48 which are shown in FIGS. 5, 6 and 8 as projecting outwardly from the surface of the rear wall 42. The vertical support ribs 48 extend from the first end 44 to the second end 46 and are positioned a selected distance apart from each other. Wall securing means 56 such as bolts, hooks, velcro, etc. may be associated with each of the support ribs 48 for mounting purposes. A generally circular waste opening 50 is provided within the front wall 40 and adjacent the first end 44. Coaxially aligned with the waste opening 50 is a second opening 52 generally extending through the rear wall 42 and between the spaced apart support ribs 48. The second opening 52 may additionally be provided with notches 54. As best shown in FIG. 7, the notches 54 would allow the receptacle unit 38 to be secured upon a wall by the bolt means 56.

Turning now to FIG. 9, the unit 38 may be provided with support ribs 60 projecting inwardly towards the interior of unit 38. This modification would allow the rear wall 42 to have a substantially flat surface while retaining the structural support the ribs 60 provide.

In use, the receptacle unit 38 is suspended from a wall as shown in FIG. 7 and the user will deposit bottles or cans or other material within the interior of the receptacle unit 38 via opening 50. When the receptacle unit 38 has been sufficiently filled, it is removed from the wall and the contents are dumped or otherwise removed from the second opening 52 extending through the rear wall 42. After emptying, the receptacle unit 38 is returned to its mounted position on the wall or other supporting surface.

FIGS. 10 through 17

Figure 10:
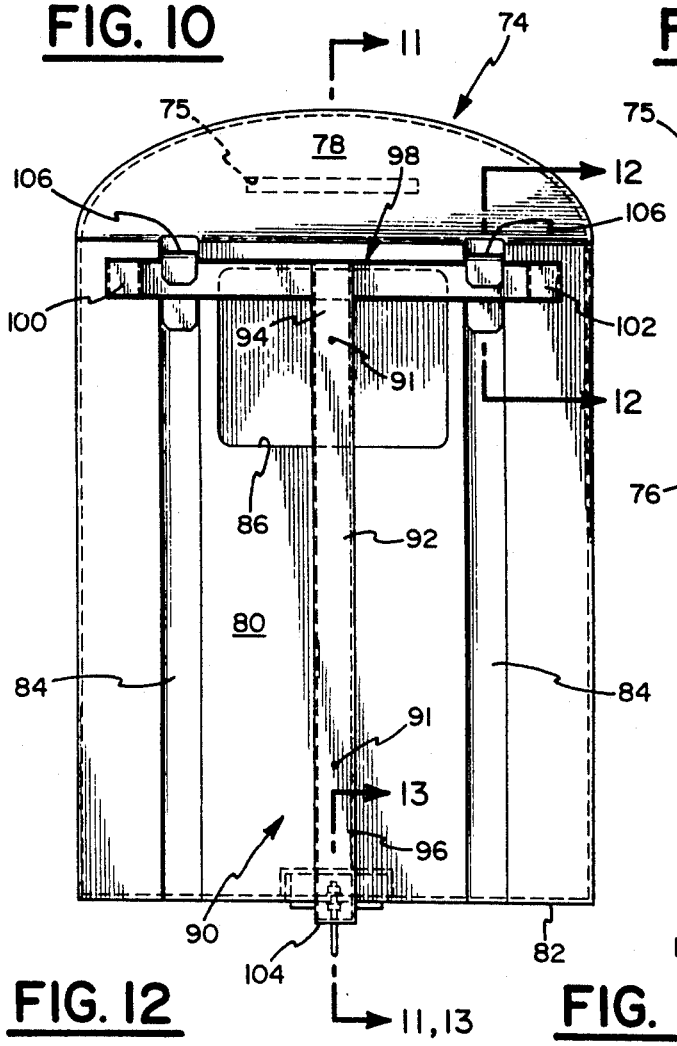
FIG. 10 illustrates a rear plan view of the receptacle unit and showing the support bracket.
Figure 11:
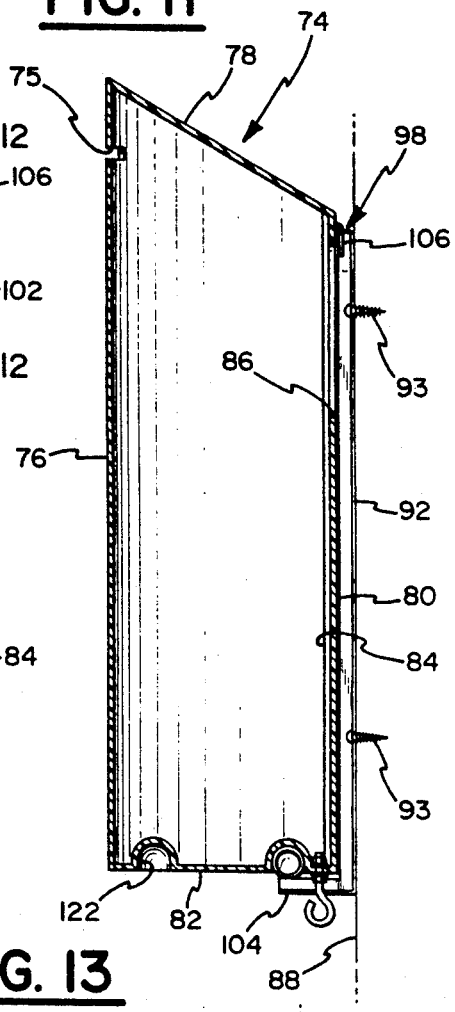
FIG. 11 is a side, cross-sectional view of the device taken along line 11—11 in FIG. 10 and viewed in the direction of the arrows and showing the device mounted to a wall.

FIGS. 10 and 11 illustrate an alternative use for the receptacle unit shown in FIG. 1 whereby a bracket assembly or support frame 90 provides a detachable wall mount for the receptacle unit. A receptacle unit 74 is provided with a front wall 76, a sloping first end 78, a generally planar rear wall 80 and second end or bottom 82. As with the receptacle units shown in FIGS. 1 and 5, it is contemplated within the scope of the present invention to position the inclined or sloping surface at either the first end 78 or the second end 82. Further, a handle (not shown) may extend through either ends 78 and 82 and into the receptacle interior.

FIGS. 10 and 11 show a generally sloping first end 78, which extends in a downward direction from the front wall 76 and to the rear wall 80. The front wall 76 has a height greater than the height of the rear wall 80. The rear wall 80 has a generally planar configuration which may optionally be provided with a pair of spaced, parallel support ribs 84 extending from the first end 78 to the second end 82. As is apparent, the receptacle unit 74 and as shown in FIGS. 10 through 15 is substantially identical to that shown in FIGS. 1 and 5.

The front wall 76 may include a first opening 75 which is sized to accommodate a particular object sought to be deposited within the interior of the receptacle unit 74. The receptacle unit 74 may function as a trash receptacle, a mail box or other depository receptacle. The particular size of the front wall opening will of course depend upon the particular utility of the receptacle unit 74. For example, in FIG. 11 the opening 75 is a narrow slot designed to accomodate letters or the like. The rear wall 80 further includes a second opening 86 which is positioned between the parallel support ribs 84. The size of the second opening 86 is selected so that the contents within the receptacle unit 74 can be readily emptied when the unit 74 is detached from its bracket assembly 90.

The bracket assembly 90 provides a means for detachably mounting the receptacle unit 74 to a wall, post or other planar surface 88. The bracket assembly 90 includes a substantially rigid support frame consisting of an elongated vertical member 92 having a first end 94 and a second end 96. The vertical member 92 contains holes 91 for mounting to a wall 88 or planar surface via bolts 93 or other appropriate means. A cross member 98 extends substantially perpendicular to the elongated vertical member first end 94 and is attached thereto. The cross member 98 comprises a first arm portion 100 and a second arm portion 102 which extend at substantially 90° right angles from the elongated vertical member 92. A foot portion 104 extends from the elongated vertical member second end 96 and in a direction substantially perpendicular to the elongated vertical member 92 and cross member 98.

Figure 12:
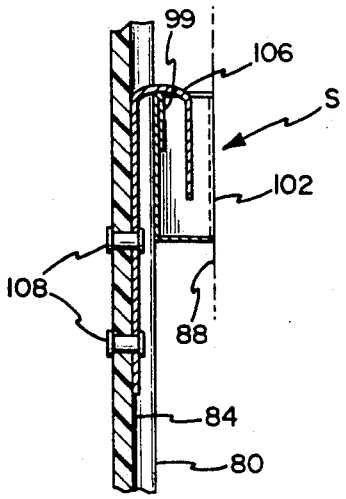
FIG. 12 is an enlarged, fragmentary sectional view taken generally along lines 12—12 in FIG. 10 and viewed in the direction of the arrows.

As best shown in FIG. 12, support means S are fixedly attached to the receptacle rear wall 80 through the use of rivets 108 or other securing means known in the art. The support means S comprise a pair of generally U-shaped, downwardly extending hooking members 106 which are adapted to interfit with each of the arm portions 100 and 102. In a preferred embodiment, the downwardly extending hooking members 106 interfit within a slot or hook receiving means 99 extending into each of arm portions 100 and 102. Other arrangements for securing the receptacle 74 to the bracket 90 are contemplated as being within the scope of the present invention so long as they both firmly support and engage the receptacle rear wall 80 to cross member 98 as generally shown.

Figure 13:
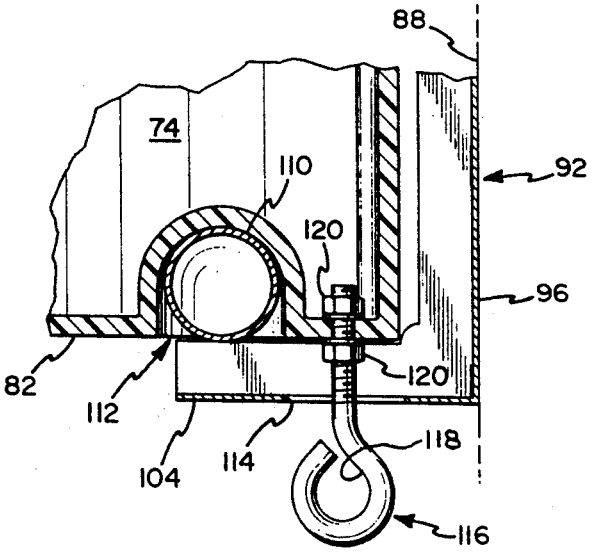
FIG. 13 is an enlarged, fragmentary sectional view taken generally along lines 13—13 in FIG. 10 and showing the foot portion and locking mechanism of the support bracket when engaged with the receptacle unit.
Figure 14:
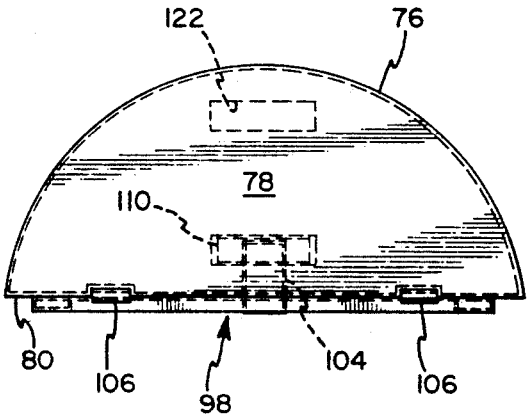
FIG. 14 is a top plan view of the device shown in FIG. 10 with both the handle and the recess for receiving the foot portion of the support bracket shown in broken lines.
Figure 15:
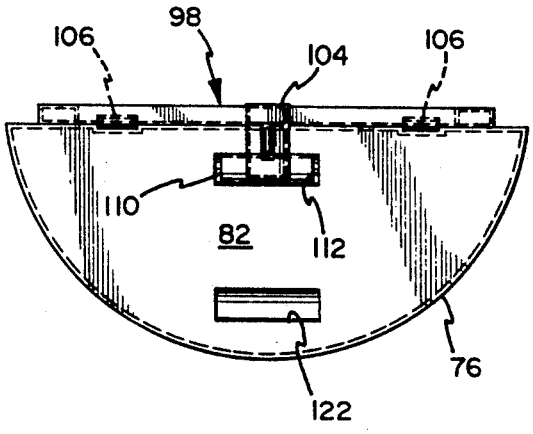
FIG. 15 is a bottom plan view of the device shown in FIG. 10.

Turning now to FIG. 13, the foot portion 104 is provided with an upwardly extending member 110 positioned a selected distance from elongated vertical member 92. The upwardly extending member 110 is shown as comprising a horizontally disposed cylinder, however, it is within the scope of the present invention to provide any of a wide variety of shapes and sizes for the upwardly extending member 110. The second end or bottom 82 of the receptacle unit 74 is provided with a recess 112 which interfits with the upwardly extending member 110. The interfit between the upwardly extending member 110 in the recess 112 is such that lateral movement between the receptacle units 74 and the support frame 90 is kept to a minimum.

The foot portion 104 contains an opening or slot 114 for receiving a locking means 116 to secure the receptacle unit 74 to support frame 90. The locking means 116 is shown in FIG. 13 as comprising a threaded member or eye screw 118 which extends through the opening 114 of foot portion 104 as well as through the second end 82 of the receptacle unit 74. A pair of nuts 120 firmly secure the eye screw 118 to the receptacle unit bottom 82 and thereby prevent unauthorized removal of the receptacle unit 74 when a padlock (not shown) or similar device is attached to the eye screw 118. It is of course within the scope of the present invention to provide any of the wide variety of locks known in the art for attachment to eye screw 118.

A handle 122 is optional shown as being recessed within the second end or bottom 82 of the receptacle unit 74. The handle 122 may have a size and dimension similar to the recess 112 which accommodates the upwardly extending member 110. The handle 122 provides a gripping surface for the user's fingers when lifting the receptacle unit 74 off of the support frame 90.

During use, bottles, cans, letters, packages, or other media are inserted within the opening 75 in front wall 76. When the receptacle unit 74 has been sufficiently filled, the locking means 116 is released and the receptacle unit 74 is lifted in an upward direction so as to disengage the hooking means 106 from each of the arm portions 100 and 102. The contents are then emptied through the second opening 86 extending in rear wall 80. Afterwards, the receptacle unit 74 is reattached to the support frame 90 by engaging the hooking means 106 to each of the arm portions 100 and 102 as well as by engaging the upwardly extending member 110 within recess 112. The locking means 116 is reinserted through opening 114, a padlock is attached and the receptacle unit 74 is thereby returned to service.

The support frame 90 may be constructed from a wide variety of materials including sheet metal, plastics or other synthetic materials. The receptacle unit can similarly be constructed from a full range of available materials. These materials include but are in no way limited to synthetic plastics, fiberglass, or metal.

While this invention has been described as having a preferred design, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

What is claimed is:

1. A trash receptacle comprising:

a) a segregated trash receiving unit;

b) said trash receiving unit including a front wall, rear wall, first end and second end;

c) said front wall and rear wall each having upper, lower, left and right side edges;

d) said front wall having a generally convex surface curved about a substantially vertical axis;

e) said rear wall having a generally planar surface;

f) said front wall left side edge being connected to said rear wall left side edge;

g) said front wall right side edge being connected to said rear wall right side edge;

h) one of said first and second ends extending from one of said upper and lower front wall edges to the corresponding other of said upper and lower rear wall edges;

i) the other of said first and second ends extending from the other of said upper and lower front wall edges to its corresponding other of said upper and lower rear wall edges;

j) said front wall including a waste opening;

k) an exterior housing surrounding said segregated trash receiving unit;

l) said exterior housing including a side and a bottom defining inner and outer surfaces, a receiving area with a top opening thereto and a segregated waste opening extending through said side;

m) said trash receiving unit front wall substantially conforming to at least a portion of said exterior housing side inner surface; said trash receiving unit front wall waste opening having a greater size than said exterior housing segregated waste opening, n) said exterior housing segregated waste opening being centrally aligned with said trash receiving unit front wall waste opening; and o) said exterior housing cooperating with said trash receiving unit to provide a first area to receive said trash receiving unit and a second area whereby said second area defining a general waste material receiving area and said trash receiving unit receiving a separate segregated waste through both said aligned exterior housing segregated waste opening and said trash receiving unit front wall waste opening.

2. A trash receptacle as in claim 1, and wherein:

a) said front wall waste opening having a restricted size so as to only allow passage therethrough of a particular size object.

3. A trash receptacle as recited in claim 1, and wherein:

a) said receptacle is manufactured from a material selected from the group consisting of plastics, fiber glass and metal.

4. A trash receptacle as recited in claim 1 and wherein:

a) said rear wall including in said generally planar surface at least two spaced substantially parallel, vertical reinforcing ribs extending from said first end to said second end.

5. A trash receptacle as recited in claim 4 and wherein:

a) said front wall waste opening aligned between said rear wall reinforcing ribs.

6. A trash receptacle as recited in claim 1 and wherein:

a) said receptacle having a height; and b) said receptacle having a width less than said height.

7. A trash receptacle as recited in claim 1 and wherein:

a) said one of said first and second ends having a sloping surface extending from said front wall to said rear wall.

8. A trash receptacle as recited in claim 7, and wherein:

a) said front wall waste opening is located near said sloping surface.

9. A trash receptacle as recited in claim 7 and wherein:

a) said sloping surface is positioned a distance below said exterior housing top opening to allow attachment of an interior housing top liner bag about said exterior housing opening and within said second area.

10. A trash receptacle as recited in claim 7 and wherein:

a) said exterior housing liner bag situated in said exterior housing second area and a portion of said bag lying atop said trash receiving unit sloping surface.

11. A trash receptacle as recited in claim 7 and wherein:

a) said exterior housing inner side surface including a pivot plate provided with an opening for receiving a locking means disposed in said sloping surface.

12. A receptacle as recited in claim 11 and wherein:

a) said locking means comprising a projecting member extendible through said pivot plate opening and provided with means to receive a padlock.

13. A trash receptacle as recited in claim 7 and wherein:

a) said sloping surface includes a handle for lifting said trash receiving unit out of said exterior housing comprising an opening extending therethrough.

* * * * *